US005374864A

United States Patent [19]

Roy et al.

[11] Patent Number: 5,374,864

[45] Date of Patent: Dec. 20, 1994

[54] ELECTRON MULTIPLIER WITH INCREASED-AREA CHANNEL

[75] Inventors: Raymond L. Roy, Monson; Peter W. Graves, Brookfield; Thomas J. Loretz, Charlton City, all of Mass.

[73] Assignee: Detector Technology, Inc., Sturbridge, Mass.

[21] Appl. No.: 758,285

[22] Filed: Aug. 28, 1991

Related U.S. Application Data

[63] Continuation of Ser. No. 393,258, Aug. 14, 1989, abandoned.

[51] Int. Cl.[5] ..... H01J 43/00

[52] U.S. Cl. ..... 313/103 CM; 313/103 R; 313/105 CM; 313/104

[58] Field of Search ..... 313/103 CM, 535, 534, 313/105 CM, 103 R, 104

[56] References Cited

U.S. PATENT DOCUMENTS

| | | | |
|---|---|---|---|
| 2,872,721 | 2/1955 | McGee | 313/105 CM X |
| 3,176,178 | 3/1965 | Goodrich et al. | 313/104 |
| 3,506,868 | 4/1970 | Ceckowski et al. | 313/534 X |
| 3,564,323 | 2/1971 | Maeda | 313/103 CM X |
| 3,649,868 | 3/1972 | Bensussan | 313/104 X |
| 3,665,497 | 5/1972 | Deradorian et al. | 313/103 R X |
| 3,718,836 | 2/1973 | Bain et al. | 313/103 X |
| 3,808,494 | 4/1974 | Hayashi et al. | 313/103 CM |
| 3,879,626 | 4/1975 | Washington et al. | 313/105 CM |
| 4,021,216 | 5/1977 | Asam et al. | 313/105 CM X |
| 4,051,468 | 9/1977 | Rajchman | 313/103 CM X |
| 4,126,804 | 11/1978 | Asam et al. | 313/105 CM |
| 4,298,817 | 11/1981 | Carett et al. | 313/103 CM X |
| 4,764,139 | 8/1988 | Murata et al. | 313/105 CM X |

*Primary Examiner*—Donald J. Yusko
*Assistant Examiner*—Nimesh Patel
*Attorney, Agent, or Firm*—Donald S. Holland

[57] ABSTRACT

A series of improved electron multipliers is shown which are capable of reducing the number of bombardments per unit area. In the preferred embodiment, the inner channel is significantly increased in surface area over that surface area of present-day multipliers. Because the surface area is increased, for the same charge throughout, the number of electron bombardments per unit area is decreased. Since the number of bombardments per unit area is reduced, there is less degradation on the inner surface of the channel and hence the device lifetime is also increased.

6 Claims, 2 Drawing Sheets

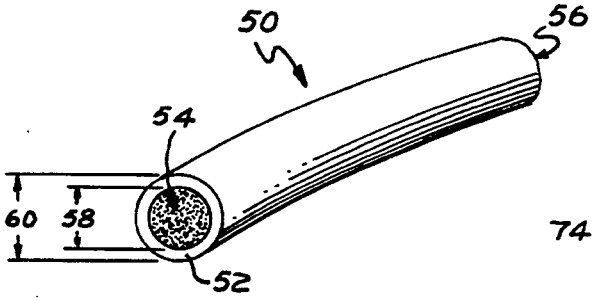
Fig.1. Prior Art
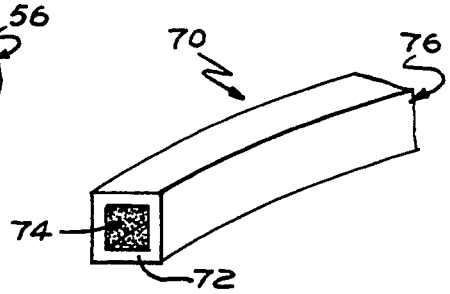
Fig.2. Prior Art
Fig.3.
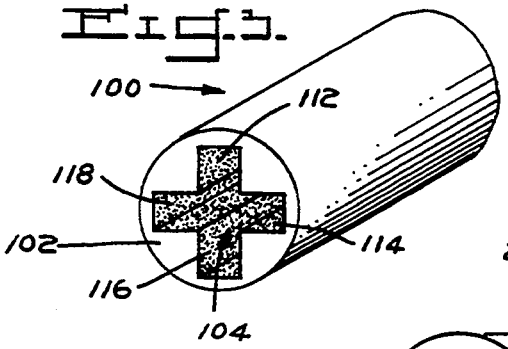
Fig.4.
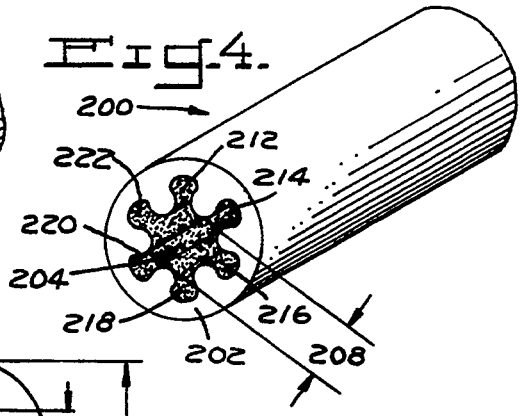
Fig.3A.
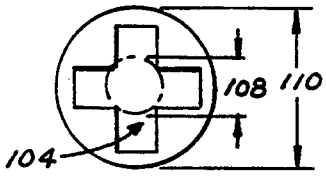
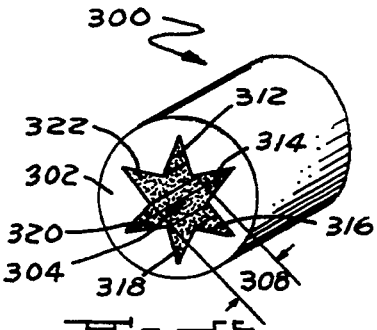
Fig.5.
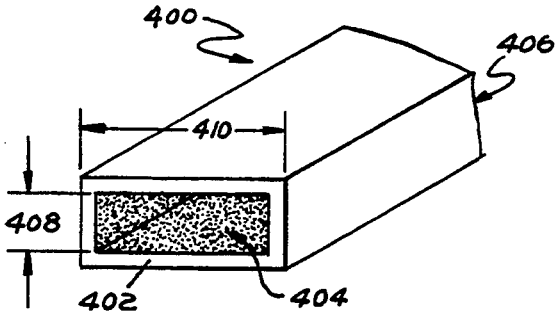
Fig.6.

ELECTRON MULTIPLIER WITH INCREASED-AREA CHANNEL

This is a continuation of application Ser. No. 07/393258, filed Aug. 14, 1989, now abandoned.

BACKGROUND OF THE INVENTION

This invention relates to continuous dynode electron multipliers ("CDEMs"). More particularly, it deals with increasing the surface area within the channel in order to reduce the number of bombardments per unit area; this ultimately results in increased device lifetime.

Continuous dynode electron multipliers have been used for years to amplify electron, ion, or photon signals. When the inside diameter is 1 mm, typically electron multiplication (gain) of $10^8$ is possible.

A particle of sufficient energy can be detected when it is incident upon the inner surface of a CDEM channel and causes the emission of at least one secondary electron. As this secondary electron is accelerated "downstream" by the electrostatic field within the channel, it gains energy. When the electron gains sufficient energy, it will release one or two secondary electrons when it strikes the inner surface again. This process may occur up to 10 to 20 times in a CDEM, depending on such factors as length of the multiplier and applied voltage. Since the number of electrons is continuously increasing, this number of particles (and consequently the number of bombardments) reaches its maximum at the output of the CDEM.

The channel of the CDEM is made of a secondary-emissive surface so designed to increase the chances that an electron will be given off. Typically, this secondary-emissive surface is a thin coating on the inner glass channel. Since it is just a thin coating, when it is struck by these particles, there is a gradual degradation of the secondary-emissive surface. Thus, this coating has a limited life; and after too many bombardments, it loses its high secondary-electron yield and renders the entire channel useless.

As a result of the increased number of electrons near the end of the channel, the number of bombardments against the inner channel likewise increases. Consequently, the surface of the rear portion of the channel takes excessive abuse; and degradation of this surface area becomes a key manufacturing and design problem. Although the typical lifespan of a multiplier is one year for normal operation, it may not last this long if it is driven excessively.

Because of this excessive wear-and-tear on the output end of the channel, a replaceable-end CDEM was invented; see pending U.S. patent application Ser. No. 07/320277, filed Mar. 6, 1989, by all of the present Applicants and two additional co-inventors. As mentioned in that application, Applicants first recognized that there are occasions when the rear portion of the channel has become useless due to excessive bombardments, while the input end remains quite usable. So, they (and their two co-inventors) invented a channel that had a replaceable end section which could be discarded when it was sufficiently worn. That invention ultimately resulted in a commercially available electron multiplier sold by Detector Technology, Inc., of Brookfield, Mass. With it there is less equipment down-time and, more importantly, cheaper costs to the user since only the defective part has to be replaced, not the entire multiplier.

This application is an extension of Applicants' earlier recognition of what causes a short CDEM lifetime —namely, excessive degradation in the channel caused by heavy electron bombardment. Applicants have now created another means to solve that problem and increase the life span of the multiplier.

Even though the design is quite different than present-day CDEMs, this new CDEM retains the same high gain typical of present-day CDEMs. Likewise, other characteristics of CDEMs, such as the signal-to-noise ratio, are virtually identical to those CDEMs presently in common use.

Applicants' research discloses that the electron gain of a CDEM diminishes in close relation to the electron charge which passes through the channel. Therefore, Applicants believe a new and unique method for extending the device lifetime is to increase the active surface area as the charge advances from the input to the output of the CDEM. By increasing the inner surface area over that of a typical multiplier (while maintaining approximately the same overall detector dimensions), the number of bombardments per unit area decreases (assuming a constant input signal). Consequently, the damage on the inner channel is less per area unit, which results in longer lifetime for the device.

There have been several prior electron multipliers with different shaped channels in the past; however, none have dealt specifically with increasing the surface area in order to reduce the number of partical bombardments per unit area.

Because the total damage to the surface is proportional to the integrated number of electron bombardments per unit area, it is a primary object of this invention to increase the surface area within the channel, therefore increasing the lifetime of the device.

It is another object of this invention to provide for an increased output current (signal) capability (dynamic range) as a result of an increased surface area.

It is yet another object to provide an improved electron multiplier which retains the high quality of common CDEMs and is likewise durable and reliable.

SUMMARY OF THE INVENTION

The inner channel of a continuous dynode electron multiplier is typically made of glass and coated with a very thin lead-bismuth secondary-emissive surface. During the multiplication process, the number of electrons continuously increases and reaches its maximum at the end of the multiplier. During operation, these electrons strike the inner channel and gradually degrade the lead-bismuth layer. Consequently, at the rear of the channel where the number of bombardments is the greatest, that portion is finally destroyed as a secondary-emitting surface.

Accordingly, this invention presents various means to avoid the excessive wear-and-tear on the secondary-emissive surface while at the same time maintaining the same basic size, and quality of excellence, of typical CDEMs. Applicants accomplish this task by significantly increasing the surface area of the standard channel. Thus, in the new device the multiplication process is spread over a larger area which results in the number of bombardments per unit area actually decreasing. Because the device lifetime is roughly proportional to degradation of this surface, Applicants have shown, through testing, that the standard lifetime is lengthened.

In this application, Applicants describe several embodiments to achieve the "increased-area" channel.

Some, for example, involve channels that have cross sections resembling irregular polygons, while another has a divergent or flared channel. A regular polygon, as defined in Hemmerling, FUNDAMENTALS OF COLLEGE GEOMETRY, p. 184 (2nd ed. 1970) is a polygon that is both equilateral and equiangular. An irregular polygon, as derived from this definition, is a polygon that is neither equilateral nor equiangular.

The effective diameter of these embodiments is designed to be equivalent to the inner diameter of typical CDEMs. Thus, usual length-to-inner-diameter (hereinafter, length-to-diameter) ratios of this invention are the same as those of present-day multipliers.

The above and other objects and advantages of this invention will become more readily apparent when the following description is read in conjunction with the accompanying drawings.

BRIEF DESCRIPTION OF THE DRAWINGS

FIG. 1 is a perspective end view of a "prior art" multiplier design encompassing a tube with an inner channel that is circular in cross-section;

FIG. 2 is a perspective end view of another "prior art" multiplier design, which utilizes a tube with a "square" inner channel;

FIG. 3 is a perspective end view of an electron multiplier tube constructed in accordance with the present invention, which utilizes a "cross" inner channel;

FIG. 3*a* is an end plan view of FIG. 3;

FIG. 4 is a perspective end view of another embodiment of this invention, which utilizes a "snowflake" inner channel;

FIG. 5 is a perspective end view of a "star" embodiment;

FIG. 6 is a perspective end view of another embodiment, which utilizes a "rectangular" inner channel;

DETAILED DESCRIPTION OF THE PREFERRED EMBODIMENTS

Figure 7:
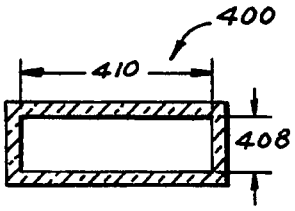
FIG. 7 is a cross-sectional view of FIG. 6.

Referring to FIGS. 3–12, and 14, a series of electron multipliers is shown constructed in accordance with the present invention. In FIG. 3 for example, the invention, generally designated by reference numeral 100, comprises an input end 102 which leads to a central throughbore or channel 104. This glass channel 104 utilizes a channel which has a surface area greater than that of electron multipliers shown in prior art (compare FIGS. 1–4). Even though this is a new design, Applicants have strived to maintain the length of standard multipliers, typical length-to-inner-diameter (hereinafter length-to-diameter) ratios and typical gain curves.

Figure 10:
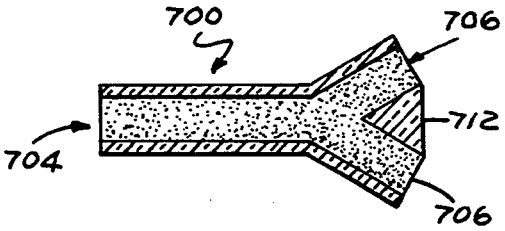
FIG. 10 is a cross-sectional side view of another embodiment, in which an inner channel is flared to make a large increase in surface area through the use of a cone-shaped insert.
Figure 11:
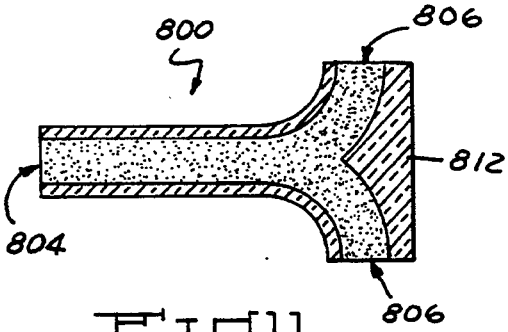
FIG. 11 is a cross-sectional side view of yet another embodiment, in which an inner channel is flared to make a large increase in surface area through the use of another insert similar to the one in FIG. 10.

Referring to FIG. 3, the input end 102 leads to a central throughbore or inner channel 104 (shown more clearly in cross-section for other embodiments in FIGS. 10, 11). This inner channel is made of any standard lead-bismuth glass compound, and this inner channel is coated with a standard secondary-emissive layer. This emissive layer is so thin that it has been omitted from the cross-sectional drawings.

The prior art, as seen in FIG. 1, is referred to generally by reference numeral 50. It has an input end 52; a glass channel 54; and an output end 56.

The standard length-to-diameter ratio of the prior art will try to be maintained in the preferred embodiments of the present invention. Typically, as shown in the prior art of FIG. 1, the inner channel diameter 58 is approximately 0.035 inches, while the outer diameter of the channel 60 is approximately 0.195 inches. However, for some embodiments (of the present invention) a precise length-to-diameter ratio is impossible to determine simply because there is no inner "diameter"; this is demonstrated in FIG. 3.

FIG. 3*a* shows an end plan view of an inner channel 104 incorporating an irregular polygon in the shape of a cross. Here the inner 37 diameter" necessary for the length-to-diameter ratio has experimentally been measured by the inner diameter 108; thus the increase in surface area is due to the remaining four channel branches 112, 114, 116, 118 (labeled in FIG. 3) which are also capable of being used for electron emission. Because there are additional channels for the flow of the electrons, the damage due to particle bombardment decreases. Since the damage to the inner channel decreases, the device life-time increases.

In the following embodiments, please note that the same features will be demonstrated, for instance, input end and output end. For simplicity, each feature has been given a standard reference numeral, but will differ by a factor of one hundred when shown in the different embodiments. For example, in FIG. 3, the input end is marked 102; while in FIG. 4 the input end is numbered 202; and in FIG. 6 it is 402. Also, note the prior art is marked with only two digits and the Applicants' invention is labeled with three digits.

Similarly, FIGS. 4, 5 utilize other irregular polygons to increase the surface area. These two designs also result in increased device lifetime for the same reasons as noted above.

FIG. 4 demonstrates a "snowflake" embodiment, generally designated by reference numeral 200. Here the inner "diameter" is measured by the inner diameter 208, which is not shown in FIG. 4, because it is analogous to the inner diameter 108 of FIG. 3. Thus there are a series of extra channels 212, 214, 216, 218, 220, 222 available for electron bombardment.

FIG. 5 shows a "star" inner channel embodiment, generally designated by reference numeral 300. It has a "diameter" measured by the inner diameter 308, which is also analogous to the inner diameter 108 of FIG. 3. Again, note the resulting additional channels 312, 314, 316, 318, 320, 322.

In FIGS. 6, 7 another irregular polygon is shown; however, a "diameter" cannot be measured so Applicants have experimentally determined an equivalent "minor axis" length or height 408. Here the "minor axis" length 408 of the channel is equivalent to the inner diameter 58 of the standard CDEM shown in FIG. 1; but the "major axis" length 410 is at least two times greater. (Anything less does not cause a significant enough improvement in the device's lifetime.) Like the previous embodiments, this changes the surface area while hardly increasing the tube's outside dimensions.

Figure 8:
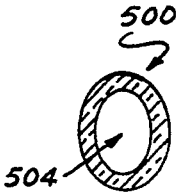
FIG. 8 is a cross-sectional end view of an 37 oval" embodiment.

FIG. 8 demonstrates an inner channel 504 that is oval. Its "minor axis" length 508 (not shown) is again equivalent to the inner diameter 58 of the standard CDEM channel (see FIG. 1); and its "major axis" or length 510 (not shown) is at least two times greater.

Figure 9:
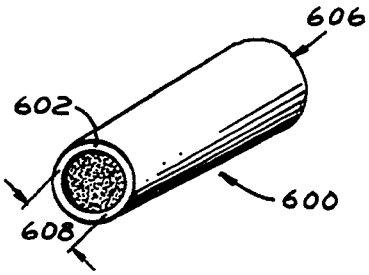
FIG. 9 is a perspective end view of a "circular" embodiment, but with increasing tubular dimensions along the length of the channel.

Applicants also envision other methods to increase the surface area. For example, instead of all of the previously shown embodiments being utilized in tubes with uniform cross sections, the channel cross section can gradually increase from the input to output ends. This is shown in FIG. 9, in which Applicants plan to have an input end 602 with a circular channel 604 (not shown, but analogous to those channels shown in FIGS. 3, 4) that gradually diverges toward the output end 606, with the outer "diameter" of the tube similarly increasing. Thus, as the number of electrons increases from input end 602 to output end 606, the surface area which the charge sees is also increased. At the output where the charge density becomes very large in standard electron multipliers, more surface area for the same amount of charge is provided (in this new embodiment) and consequently this reduces the resulting surface damage per unit area. Hence, the lifetime of the standard device is increased in yet another way. This is demonstrated in FIG. 14, which shows a cross-sectional view of circular channel that increases in size.

Applicants also assert that a "split channel" can be used to increase the surface area (see FIG. 10). In this multiplier 700, the general shape is that of a wine bottle. Towards the end portion 706, there is a conical insert 712 which creates one continuous channel around the insert; it is not two discrete channels as it appears in the cross-sectional view of FIG. 10.

The multiplier 800 shown in FIG. 11 is similar to that shown in FIG. 10. At the center of the glass channel 804, the insert 812 comes to a maximum and at the ends it does not taper as rapidly as that shown in FIG. 10.

Figure 12:
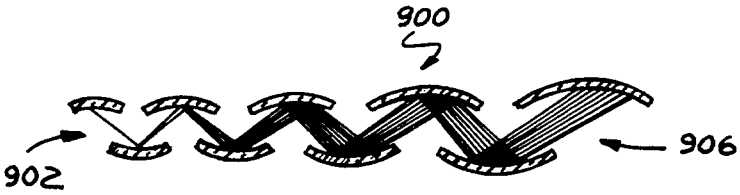
FIG. 12 is a cross-sectional side view of a discrete dynode electron multiplier, which also utilizes the increased surface area concept of the present invention.
Figure 13:
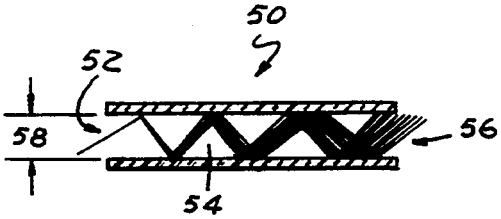
Fig.13. Prior Art
FIG. 13 is a cross-sectional view of a "prior art" electron multiplier tube, which demonstrates the high charge-to-surface-area ratio that results from:its use.
Figure 14:
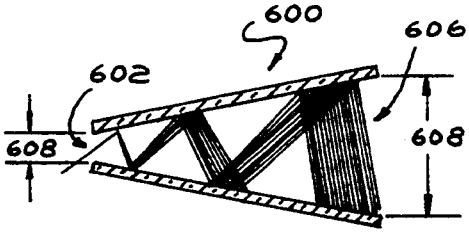
FIG. 14 is a cross-sectional side view of a FIG. 9 device in use, which shows the reduced charge-to-surface-area ratio for a multiplier tube constructed in accordance with the present invention.

Applicants also envision that this same increased surface area technique could be applied to discrete dynode electron multipliers as shown in FIG. 12. Here, each dynode increases in size (in the same general manner as depicted above) as the number of bombardments increases. At the same time, for charge spreading considerations, the distance between opposing dynodes is also gradually increased; or, the voltage on each can be gradually decreased.

It should be understood by those skilled in the art that obvious structural modifications can be made without departing from the spirit or scope of the invention. For example, although Applicants have only shown symmetrical designs, they also envision that asymmetrical designs could be used. Accordingly, reference should be made primarily to the accompanying claims, rather than the foregoing specification, to determine the scope of the invention.

Having thus described the invention, what is claimed is:

1. A tube for a continuous dynode electron multiplier for producing electron gain, said multiplier tube comprising:

a. an input end;

b. an output end;

c. a channel that extends through the tube, from the input end to the output end, said channel having a secondary-emissive surface; and d. wherein the channel has a cross section that is in the shape of a cross.

2. A tube for a continuous dynode electron multiplier for producing electron gain, said multiplier tube comprising:

a. an input end;

b. an output end;

c. a channel that extends through the tube, from the input end to the output end, said channel having a secondary-emissive surface and a longitudinal axis; and d. wherein the channel has a cross section along its entire length, taken at a right angle to the channel's longitudinal axis, that is in the shape of a rectangle, said rectangle having a length that is greater than twice its height.

3. A tube for a continuous dynode electron multiplier for producing electron gain, said multiplier tube comprising:

a. an input end;

b. an output end;

c. a channel that extends through the tube, from the input end to the output end, said channel having a secondary-emissive surface; and d. wherein the tube and channel have constant diameters from the input end to a mid-section of the tube, whereupon the channel diverges into a conical portion with two surfaces.

4. A tube for a continuous dynode electron multiplier for producing electron gain, said multiplier tube comprising:

a. an input end;

b. an output end;

c. a channel that extends through the tube, from the input end to the output end, said channel having a secondary-emissive surface and a longitudinal axis; and d. means for reducing the number of electron bombardments per unit area within the tube to extend the lifetime of the multiplier, said means comprising the channel having a cross section along its entire length, taken at a right angle to the channel's longitudinal axis, that is in the shape of a rectangle, wherein said rectangle has a length that is longer than twice its height.

5. A tube for a continuous dynode electron multiplier for producing electron gain, said multiplier tube comprising:

a. an input end;

b. an output end;

c. a channel that extends through the tube, from the input end to the output end, said channel having a secondary-emissive surface and a longitudinal axis; and d. means for reducing the number of electron bombardments per unit area within the tube to extend the lifetime of the multiplier, said means comprising the channel having a cross section along its entire length, taken at a right angle to the channel—s longitudinal axis, that is in the shape of an oval, said oval having a major axis length and a minor axis length, wherein the major axis length is more than twice the minor axis length.

6. A tube for a continuous dynode electron multiplier for producing electron gain, said multiplier tube comprising:

a. an input end;

b. an output end;

c. a channel that extends through the tube, from the input end to the output end, said channel having a secondary-emissive surface and a longitudinal axis; and d. means for reducing the number of electron bombardments per unit area within the tube to extend the lifetime of the multiplier, said means comprising the channel having a cross section along its entire length, taken at the right angle to the channel's longitudinal axis, that is in the shape of an irregular polygon, said polygon having a major axis length and a minor axis length, wherein the polygon's major axis length is more than twice its minor axis length.

* * * * *